US008037657B2

(12) United States Patent
Sjoberg et al.

(10) Patent No.: US 8,037,657 B2
(45) Date of Patent: Oct. 18, 2011

(54) PANEL AND PROCESS FOR SEALING OF A PANEL JOINT

(75) Inventors: Ake Sjoberg, Lund (SE); Hakan Wernersson, Lund (SE); Krister Hansson, Trelleborg (SE); Magnus Nilsson, Vellinge (SE); Nils-Erik Engstrom, Trelleborg (SE); Sven Kornfalt, Malmo (SE)

(73) Assignee: Pergo AG, Barr (CH)

( * ) Notice: Subject to any disclaimer, the term of this patent is extended or adjusted under 35 U.S.C. 154(b) by 1269 days.

(21) Appl. No.: 10/793,944

(22) Filed: Mar. 8, 2004

(65) Prior Publication Data

US 2004/0182036 A1 Sep. 23, 2004

(51) Int. Cl.
*E04B 2/00* (2006.01)

(52) U.S. Cl. ..... 52/592.1; 428/192; 156/304.5; 52/741.4

(58) Field of Classification Search ..... 52/592.1, 52/592.2, 592.4, 591.3, 591.1, 741.4; 428/192; 156/304.5
See application file for complete search history.

(56) References Cited

U.S. PATENT DOCUMENTS

| | | | | |
|---|---|---|---|---|
| 3,813,368 | A * | 5/1974 | Villa | 560/7 |
| 3,950,280 | A * | 4/1976 | Singleton | 523/100 |
| 4,599,841 | A * | 7/1986 | Haid | 52/396.04 |
| 4,644,719 | A * | 2/1987 | Salazar | 52/384 |
| 4,822,655 | A * | 4/1989 | Foster | 428/41.3 |
| 5,338,574 | A * | 8/1994 | O'Neil et al. | 427/387 |
| 5,394,672 | A * | 3/1995 | Seem | 52/794.1 |
| 5,502,939 | A * | 4/1996 | Zadok et al. | 52/309.9 |
| 5,843,552 | A * | 12/1998 | Karrfalt | 428/57 |
| 5,939,203 | A * | 8/1999 | Kappock et al. | 428/469 |
| 6,006,486 | A * | 12/1999 | Moriau et al. | 52/589.1 |
| 6,101,778 | A | 8/2000 | Martensson | |
| 6,314,701 | B1 * | 11/2001 | Meyerson | 52/588.1 |
| 6,421,970 | B1 | 7/2002 | Martensson et al. | |
| 6,449,918 | B1 * | 9/2002 | Nelson | 52/582.1 |
| 6,505,452 | B1 * | 1/2003 | Hannig et al. | 52/582.1 |
| 6,766,622 | B1 | 7/2004 | Thiers | |
| 6,830,799 | B1 * | 12/2004 | Duffin et al. | 428/131 |
| 6,874,292 | B2 * | 4/2005 | Moriau et al. | 52/590.2 |
| 6,922,965 | B2 * | 8/2005 | Rosenthal et al. | 52/592.1 |

(Continued)

FOREIGN PATENT DOCUMENTS

DE 29703962 6/1997

(Continued)

OTHER PUBLICATIONS

Random House Unabridged Dictionary, © 2010; available at http://www.dictionary.com.*

(Continued)

*Primary Examiner* — Robert Canfield
*Assistant Examiner* — Brent W Herring
(74) *Attorney, Agent, or Firm* — Novak Druce + Quigg LLP

(57) ABSTRACT

A joint for panels, the panels comprising a core, a decorative upper surface and edges provided with joining means for positioning the panels towards one another. Predetermined portions of the edges are provided with a layer of polymer. The panels are joined to one another by use of the joining means where the polymer forms a seal in the joint preventing penetration of water into the joint wherein a highly water resistant unit of a plurality of panels is formed.

14 Claims, 2 Drawing Sheets

U.S. PATENT DOCUMENTS

| | | | | |
|---|---|---|---|---|
| 6,931,811 | B2 * | 8/2005 | Thiers | 52/592.1 |
| 6,972,888 | B2 * | 12/2005 | Poll et al. | 359/265 |
| 7,131,242 | B2 * | 11/2006 | Martensson et al. | 52/591.3 |
| 7,251,916 | B2 * | 8/2007 | Konzelmann et al. | 52/592.1 |
| 7,516,588 | B2 * | 4/2009 | Pervan | 52/592.1 |
| 2002/0007909 | A1 * | 1/2002 | Mott et al. | 156/307.3 |
| 2002/0046526 | A1 * | 4/2002 | Knauseder | 52/581 |
| 2002/0170257 | A1 * | 11/2002 | McLain et al. | 52/539 |
| 2002/0189183 | A1 | 12/2002 | Ricciardelli | |
| 2003/0024199 | A1 * | 2/2003 | Pervan et al. | 52/589.1 |
| 2003/0141004 | A1 * | 7/2003 | Palmblad et al. | 156/64 |
| 2004/0031225 | A1 | 2/2004 | Fowler | |
| 2004/0031226 | A1 | 2/2004 | Miller et al. | |
| 2004/0031227 | A1 | 2/2004 | Knauseder | |
| 2004/0035079 | A1 | 2/2004 | Evjen | |
| 2005/0016107 | A1 * | 1/2005 | Rosenthal et al. | 52/578 |
| 2006/0010820 | A1 * | 1/2006 | Schwitte et al. | 52/592.1 |
| 2007/0119110 | A1 * | 5/2007 | Pervan | 52/403.1 |
| 2007/0159814 | A1 * | 7/2007 | Jacobsson | 362/153 |

FOREIGN PATENT DOCUMENTS

| | | |
|---|---|---|
| DE | 19821938 | 11/1999 |
| DE | 10131248 | 1/2003 |
| WO | 03093686 | 11/2003 |

OTHER PUBLICATIONS

George E. Linton; The Modern Textile Dictionary; Duell, Sloan and Pearce; p. 246.

Kirk Othmer; Encyclopedia of Chemical Technology; John Wiley & Sons; Colorants for Plastics; vol. 6; Third Edition; p. 597.

* cited by examiner

PANEL AND PROCESS FOR SEALING OF A PANEL JOINT

The present invention relates to sealing of a joint comprising glued edges.

Prefabricated surface elements which at their edges are provided with groove and tenon are well known nowadays. As these are very easy to install, it is possible for the normal handy man to achieve this. Such elements can be constituted of massive wood, fibre board or particle board. These are often provided with a surface layer, such as lacquer or some sort of laminate. The boards are most often installed by gluing them together via their groove and tenon. It is desired to join the separate elements so closely that the joint becomes practically invisible, which increases the moisture resistance radically. The usable life of the installed elements are hereby also increased. It is essential that glue is used excessively in order to achieve a tight joint. Any gaps will make it possible for moisture to penetrate the joint with subsequent swelling of the core material closest to the joint. The glue also have to be used to an amount that it is spill out trough the joint on the decorative side of the surface elements. The superfluous glue will of course have to be wiped off before beginning to set, which is very time consuming.

One way of solving the problem is available on the market for some time now through different types of so-called click or snap-lock floor boards where no glue is to be used. The installation of such floor boards has become much swifter as no glue is required and the locking systems will in most cases provide adequate mechanical strength keeping the floor boards together. The problems with these type of surface elements are that relatively small spills of fluids like water may cause great damage on the installed surface elements as well as sub walls and especially subfloors as the fluid will run through the joints rather rapidly due to the capillary effect. It is, of course, possible to use glue on these snap-lock type of elements as well although the problem with the time consuming cleaning during installation would remain.

It has, through the present invention, been made possible to solve the above mentioned problems so that self sealing surface elements can be achieved. Accordingly the invention relates to a joint for panels, the panels comprising a core, a decorative upper surface and edges provided with joining means for positioning the panels towards one another. Predetermined portions of the edges are provided with a layer of polymer. The panels are joined to one another by use of the joining means where the polymer forms a seal in the joint preventing penetration of water into the joint wherein a highly water resistant unit of a plurality of panels is formed.

The panels are according to one embodiment of the invention provided with male and female edges, the male edges being intended to being joined with the female edges. According to another embodiment of the invention at least two of the edges arranged on opposite sides of the panel are provided with female edges which are joined together by means of a separate profile having two mail edges.

According to one preferred embodiment of the invention predetermined parts of mating surfaces of the male edges and female edges respectively are each provided with the layer of polymer. It is advantageous to coat at least the parts of the edges closest to the upper decorative surface as this will protect the core material from absorbing moisture and spills from above.

It is suitable to choose a polymer for the mating surfaces which migrates and merges to form a unit. There are a number of known polymers which have this property. It is advantageous to use a polymer with good storage stability and which do not dry out or form skin before the installation.

As an example of a polymer which may be used can be mentioned contact glue which normally is of a nitril rubber type. The disadvantage with this polymer system is that it dries out and crystallise rather quickly, and is therefore not the best of choices. It might however be used if reactivated in connection to the assembly by adding a solvent or by heating the joint.

Another example of a polymer which is suitable is non-curing thermoplastic sealants like a butyl rubber. One specific example of such a polymer which has shown to be useful is Bostic® Butyl 1124. It is also possible to use polymers like ethyl-vinyl-acetate (EVA) or polymer blends containing EVA.

It is also possible to use natural resins like for example natural bitumen and also different types of oil distillate like technical bitumen.

It is advantageous if the polymer is water repellent.

The invention is described further in connection to enclosed drawing showing different embodiments of the invention whereby;

Figure 4A:
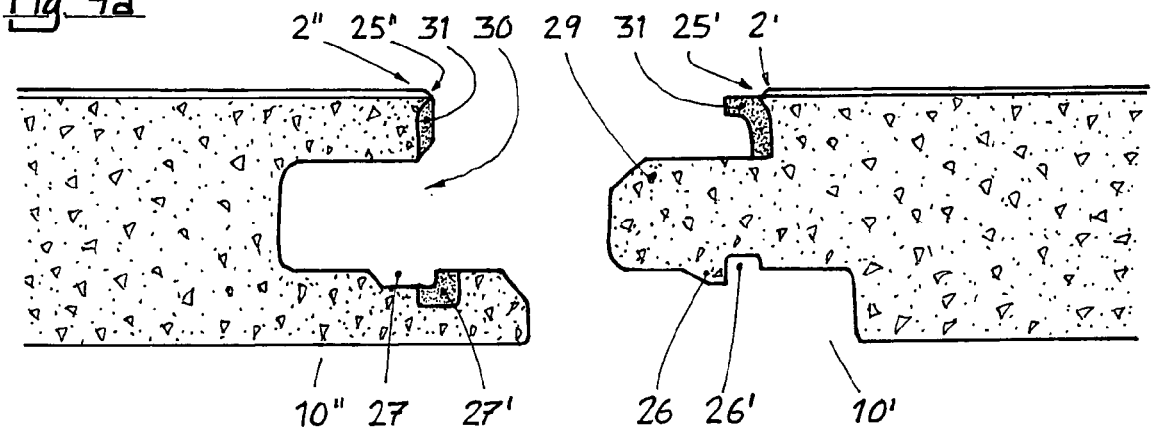
Figure 4B:
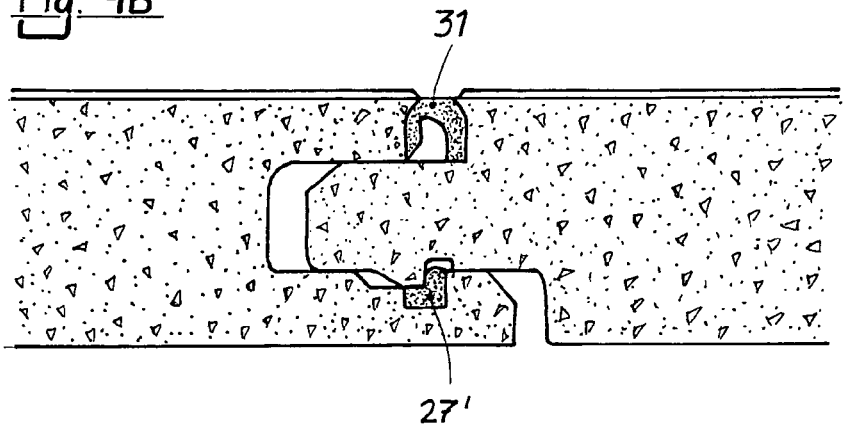
Figure 4C:
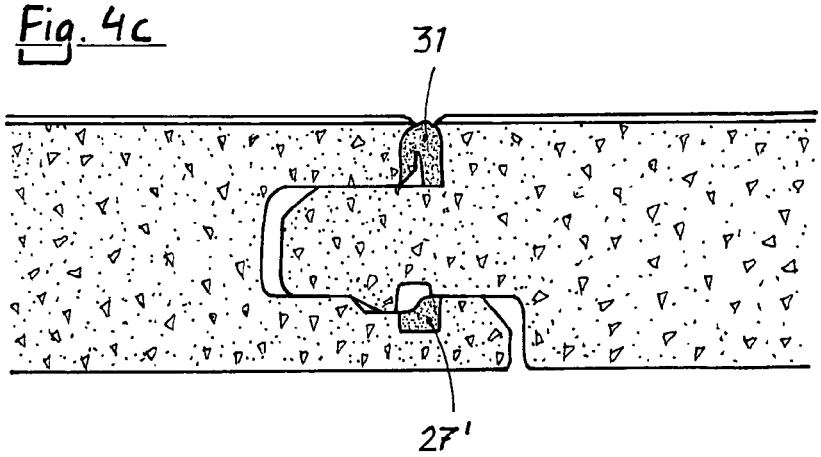

FIG. 4*a*-4*c* shows a special embodiment of adjacent edges of two panels to be joined according to the present invention.

Figure 1:
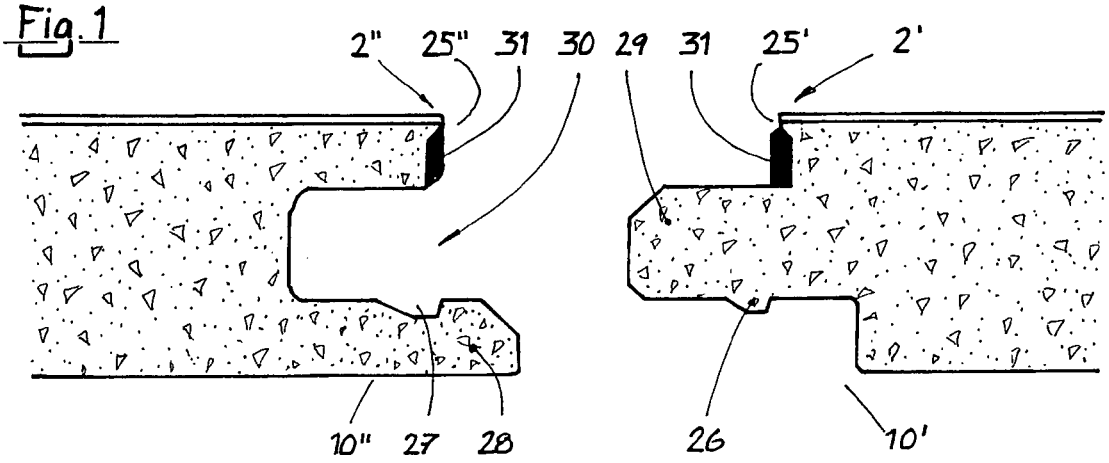
FIG.1 shows a first embodiment of adjacent edges of two panels to be joined according to the present invention.

FIG. 1 shows, in cross-section, two adjacent edges according to a first embodiment of the invention. The panels 1 are provided with a first assembly joining member $\mathbf{10}^{I}$ on a male edge $\mathbf{2}^{I}$ while a female edge $\mathbf{2}^{II}$ is provided with a second assembly joining member $\mathbf{10}^{II}$. The female edge $\mathbf{2}^{II}$ is arranged on a side opposite to the male edge $\mathbf{2}^{I}$. The first assembly joining member $\mathbf{10}^{I}$ is provided with a lower snapping web 26 arranged on the lower side of a tongue. The lower snapping web 26 is intended to interact with a recess 27 arranged on a lower cheek 28 arranged on the second vertical assembly joining members $\mathbf{10}^{II}$ so that two joined adjacent panels 1 are locked against each other in a horizontal direction. The lower cheek 28 forms a lower surface of a groove 30 in the female edge $\mathbf{2}^{II}$.

The joint between a male and a female edge $\mathbf{2}^{I}$ and $\mathbf{2}^{II}$ respectively of two joined panels 1 further comprises contact surfaces which are constituted by the lower snapping web 26 and recess 27, the tongue 29 and groove 30 as well as upper male and female mating surfaces $\mathbf{25}^{I}$ and $\mathbf{25}^{II}$ respectively. These upper male and female mating surfaces $\mathbf{25}^{I}$ and $\mathbf{25}^{II}$ respectively are provided with recesses in which a polymer sealer 31 is applied. This polymer is suitably a non-curing thermoplastic elastomeric sealant which will merge over the edge once assembled so that the two separate polymer sealers 31 will fuse over time to form one elastic seal. It is also possible to utilise other thermoplastic elastomers where only one of the upper mating surfaces $\mathbf{25}^{I}$ or $\mathbf{25}^{II}$ respectively are provided with a polymer sealer 31 comprising a plasticiser while the other upper mating surface $\mathbf{25}^{I}$ or $\mathbf{25}^{II}$ respectively is provided with a polymer sealer 31 lacking this plasticiser. Once the panels are joined and the polymer sealer 31 of the two mating surfaces $\mathbf{25}^{I}$ and $\mathbf{25}^{II}$ respectively, are in contact, the plasticiser will start to migrate and a glue-like effect will be obtained. It is also possible to use an expansion agent in the polymer sealer which will improve the elastic properties of the seal.

The polymer sealer 31 is primarily used for sealing the joint, thereby improving the water and moisture resistance of an installed surface comprising panels according to the invention. The assembly joining members $\mathbf{10}^{I}$ and $\mathbf{10}^{II}$ respectively will give the mechanical strength of the joint.

The joint between two joined panels 1 also comprises cavities which are formed between the surfaces of the assembled joint. These cavities will give room for any loose particles that inevitably will be present in the joint. These particles may otherwise obstruct the installation in different ways, like causing so-called proud edges locally.

Figure 2:
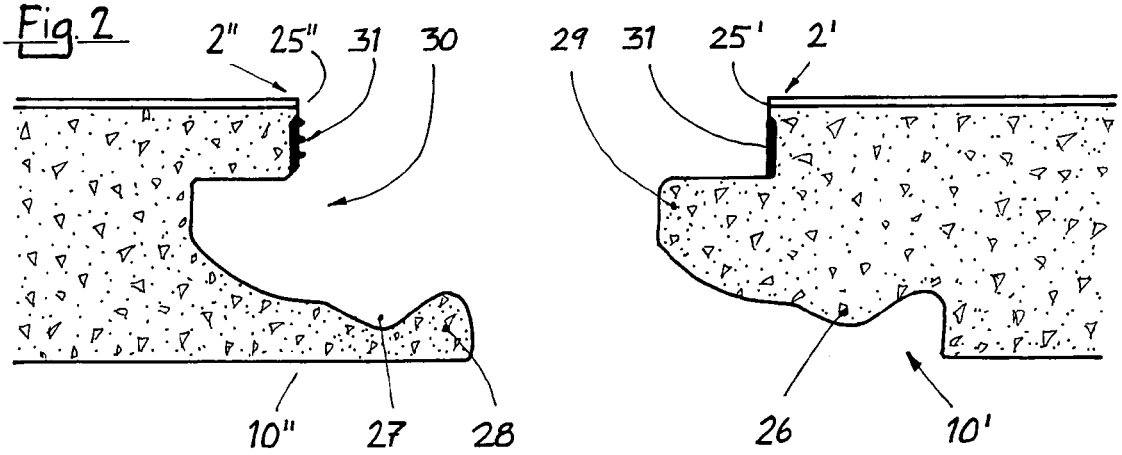
FIG. 2 shows a second embodiment of adjacent edges of two panels to be joined according to the present invention.

FIG. 2 shows, in cross-section, two adjacent edges according to a second embodiment of the invention. The embodiment shows similarities with the embodiment shown in FIG. 1. The panels 1 are provided with a first assembly joining member $\mathbf{10}^{I}$ on a male edge $\mathbf{2}^{I}$ while a female edge $\mathbf{2}^{II}$ is provided with a second assembly joining member $\mathbf{10}^{II}$. The female edge $\mathbf{2}^{II}$ is arranged on a side opposite to the male edge $\mathbf{2}^{I}$. The first assembly joining member $\mathbf{10}^{I}$ is provided with a lower snapping web 26 arranged on the lower side of a tongue. The lower snapping web 26 is intended to interact with a recess 27 arranged on a lower cheek 28 arranged on the second vertical assembly joining members $\mathbf{10}^{II}$ so that two joined adjacent panels 1 are locked against each other in a horizontal direction. The lower cheek 28 forms a lower surface of a groove 30 in the female edge $\mathbf{2}^{II}$.

The joint between a male and a female edge $\mathbf{2}^{I}$ and $\mathbf{2}^{II}$ respectively of two joined panels 1 further comprises contact surfaces which are constituted by the lower snapping web 26 and recess 27, the tongue 29 and groove 30 as well as upper male and female mating surfaces $\mathbf{25}^{I}$ and $\mathbf{25}^{II}$ respectively. These upper male and female mating surfaces $\mathbf{25}^{I}$ and $\mathbf{25}^{II}$ respectively are provided with recesses in which a polymer sealer 31 is applied. This polymer is suitably a non-curing thermoplastic elastomeric sealant which will merge over the edge once assembled so that the two separate polymer sealers 31 will fuse over time to form one elastic seal. In order to ensure a good initial pressure over the joint between the two polymer sealers 31, at least one of them is provided with a number of narrow, protruding lips $\mathbf{31}^{I}$. These narrow, protruding lips $\mathbf{31}^{I}$ will make the need of a narrow matching and manufacturing tolerance in respect of the thickness of the two polymer sealers 31 less critical. It will hereby be possible to avoid problems caused by having applied polymer sealers 31 that are too thick. This would otherwise cause problems during installation and could also cause the polymer sealers 31 to being squeezed up on top of the laminate where the abundant polymer sealer 31 is easily removed. Nevertheless, it is desired to avoid this extra operation in the installation process. It is further possible to use an expansion agent in the polymer sealer which will further improve the elastic properties of the seal.

The polymer sealer 31 is primarily used for sealing the joint, thereby improving the water and moisture resistance of an installed surface comprising panels according to the invention. The assembly joining members $\mathbf{10}^{I}$ and $\mathbf{10}^{II}$ respectively will give the mechanical strength of the joint.

The joint between two joined panels 1 also comprises cavities which are formed between the surfaces of the assembled joint.

Figure 3:
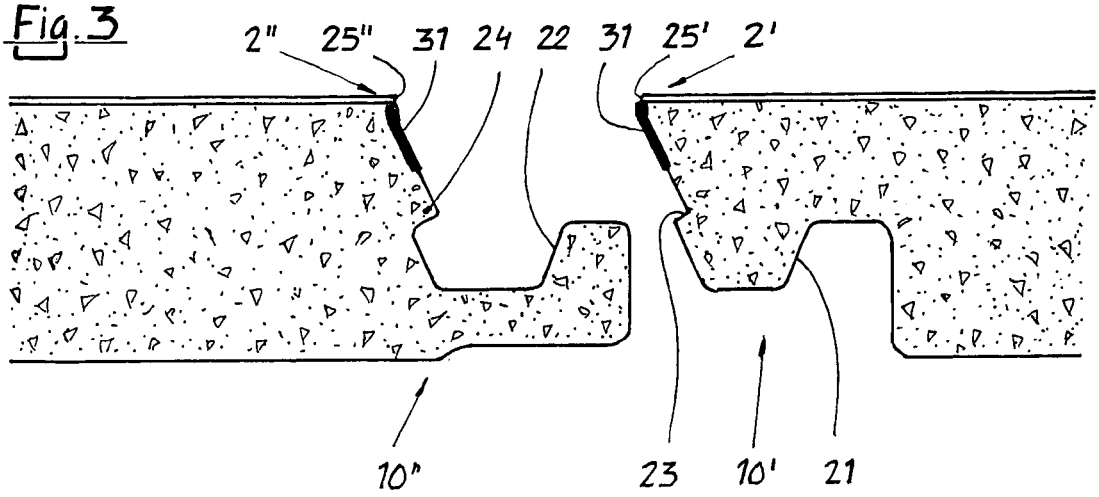
FIG. 3 shows a third embodiment of adjacent edges of two panels to be joined according to the present invention.

FIG. 3 shows, in cross-section, two adjacent edges according to a third embodiment of the invention. The panels 1 are provided with a first vertical assembly joining member $\mathbf{10}^{I}$ on a male edge $\mathbf{2}^{I}$ while a female edge $\mathbf{2}^{II}$ is provided with a second vertical assembly joining member $\mathbf{10}^{II}$. The female edge $\mathbf{2}^{II}$ is arranged on a side opposite to the male edge $\mathbf{2}^{I}$. The first vertical assembly joining member $\mathbf{10}^{I}$ is provided with mainly vertical lower cheek surfaces 21 arranged parallel to the closest edge 2. The lower cheek surfaces 21 are intended to interact with mainly vertical upper cheek surfaces 22 arranged on the second vertical assembly joining members $\mathbf{10}^{II}$ so that two joined adjacent panels 1 are locked against each other in a horizontal direction. The first vertical assembly joining member $\mathbf{10}^{I}$ is moreover provided with a snapping hook 23 while the second vertical assembly joining member $\mathbf{10}^{II}$ is provided with a matching undercut 24, which by being provided with mainly horizontal locking surfaces limits the vertical movement between two joined adjacent panels 1.

The joint between a male and female edge $\mathbf{2}^{I}$ and $\mathbf{2}^{II}$ respectively of two joined panels 1 further comprises contact surfaces which are constituted by the locking surfaces of the under cuts 23 and hooks 24, the mainly vertical upper cheek surfaces 22, lower cheek surfaces 21 as well as upper mating surfaces 25.

The joint between a male and a female edge $\mathbf{2}^{I}$ and $\mathbf{2}^{II}$ respectively of two joined panels 1 further comprises contact surfaces which are constituted by the lower snapping web 26 and recess 27, the tongue 29 and groove 30 as well as upper male and female mating surfaces $\mathbf{25}^{I}$ and $\mathbf{25}^{II}$ respectively. These upper male and female mating surfaces $\mathbf{25}^{I}$ and $\mathbf{25}^{II}$ respectively are provided with recesses in which a polymer sealer 31 is applied. This polymer is suitably a non-curing thermoplastic elastomeric sealant which will merge over the edge once assembled so that the two separate polymer sealers 31 will fuse over time to form one elastic seal. It is also possible to utilise other thermoplastic elastomers where only one of the upper mating surfaces $\mathbf{25}^{I}$ or $\mathbf{25}^{II}$ respectively are provided with a polymer sealer 31 comprising a plasticiser while the other upper mating surface $\mathbf{25}^{I}$ or $\mathbf{25}^{II}$ respectively is provided with a polymer sealer 31 lacking this plasticiser. Once the panels are joined and the polymer sealer 31 of the two mating surfaces $\mathbf{25}^{I}$ and $\mathbf{25}^{II}$ respectively, are in contact, the plasticiser will start to migrate and a glue-like effect will be obtained. As described in connection to FIG. 2 above it is also possible to provide at least one of the two polymer sealers 31 with one or a number of narrow, protruding lips $\mathbf{31}^{I}$ in order to ensure a good initial pressure over the joint between the two polymer sealers 31. These narrow, protruding lips $\mathbf{31}^{I}$ will make the need of a narrow matching and manufacturing tolerance in respect of the thickness of the two polymer sealers 31 less critical. It is further possible to use an expansion agent in the polymer sealer which also will improve the elastic properties of the seal.

The polymer sealer 31 is primarily used for sealing the joint, thereby improving the water and moisture resistance of an installed surface comprising panels according to the invention. The assembly joining members $\mathbf{10}^{I}$ and $\mathbf{10}^{II}$ respectively will give the mechanical strength of the joint.

The joint between two joined panels 1 also comprises cavities which are formed between the surfaces of the assembled joint. These cavities will give room for any loose particles that inevitably will be present in the joint. These particles may otherwise obstruct the installation in different ways, like causing so-called proud edges locally.

It is according to a special embodiment of the invention possible to use one type of joint on two of the edges 2, arranged on opposite sides, while remaining, adjacent edges 2 are provided with a second type of joint. It is accordingly possible to use the joint shown in figure one or two on the long side edges 2 of a rectangular panel 1, while the short side edges 2 are provided with a joint as shown in figure three. It is of course also possible to use the same type of joint on all edges 2 of the panel 1. The panel 1 may of course also have other shapes than being rectangular.

FIG. 4*a*, 4*b* and 4*c* shows, in cross-section, a special embodiment of the invention. FIG. 4*a* shows two adjacent edges before assembly while FIG. 4*b* and 4*c* shows the same edges assembled. The embodiment shows similarities with the embodiment shown in FIG. 1. The panels 1, as best viewed in FIG. 4*a*, are provided with a first assembly joining member $\mathbf{10}^{I}$ on a male edge $\mathbf{2}^{I}$ while a female edge $\mathbf{2}^{II}$ is provided with a second assembly joining member $\mathbf{10}^{II}$. The female edge $\mathbf{2}^{II}$ is arranged on a side opposite to the male edge $\mathbf{2}^{I}$. The first assembly joining member $\mathbf{10}^{I}$ is provided with a lower snapping web 26 arranged on the lower side of a tongue. A web recess $\mathbf{26}^{I}$ is located behind the lower snapping web 26. The lower snapping web 26 is intended to interact with a recess 27 arranged on a lower cheek 28 arranged on the second vertical assembly joining members $\mathbf{10}^{II}$ so that two joined adjacent panels 1 are locked against each other in a horizontal direction. The lower cheek 28 forms a lower surface of a groove 30 in the female edge $\mathbf{2}^{II}$. A flexible insert $\mathbf{27}^{I}$ is located in the recess 27. This flexible insert $\mathbf{27}^{I}$ is located between the recess 27 and the lower snapping web 26 and will allow a limited movement in horizontal direction between the panels. The web recess $\mathbf{26}^{I}$ will leave space for the flexible insert $\mathbf{27}^{I}$ to bulge out when being compressed.

The joint between a male and a female edge $\mathbf{2}^{I}$ and $\mathbf{2}^{II}$ respectively of two joined panels 1 further comprises contact surfaces which are constituted by the lower snapping web 26 and recess 27, the tongue 29 and groove 30 as well as upper male and female mating surfaces $\mathbf{25}^{I}$ and $\mathbf{25}^{II}$ respectively. These upper male and female mating surfaces $\mathbf{25}^{I}$ and $\mathbf{25}^{II}$ respectively are provided with recesses in which a polymer sealer 31 is applied. This polymer, which suitably also is used when manufacturing the flexible insert $\mathbf{27}^{I}$, is suitably a non-curing thermoplastic elastomeric sealant which will merge over the edge once assembled so that the two separate polymer sealers 31 will fuse over time to form one elastic seal. In order to ensure a good initial pressure over the joint between the two polymer sealers 31, at least one of them is provided with a number of narrow, protruding lips $\mathbf{31}^{I}$. These narrow, protruding lips $\mathbf{31}^{I}$ will make the need of a narrow matching and manufacturing tolerance in respect of the thickness of the two polymer sealers 31 less critical. It will hereby be possible to avoid problems caused by having applied polymer sealers 31 that are too thick. This would otherwise cause problems during installation and could also cause the polymer sealers 31 to being squeezed up on top of the laminate where the abundant polymer sealer 31 is easily removed. Nevertheless, it is desired to avoid this extra operation in the installation process. It is further possible to use an expansion agent in the polymer sealer which will further improve the elastic properties of the seal.

The polymer sealer 31 is primarily used for sealing the joint, thereby improving the water and moisture resistance of an installed surface comprising panels according to the invention. The assembly joining members $\mathbf{10}^{I}$ and $\mathbf{10}^{II}$ respectively will give the mechanical strength of the joint.

The polymer sealer 31 together with the flexible insert will allow a limited movement between two adjacent panels 1 with a maintained seal protecting from penetration of moisture. The amount of movement allowed is easily adjusted through the dimensions of the recess 27, polymer sealer 31 and flexible insert $\mathbf{27}^{I}$. It is advantageous to use the invention as described in connection to FIG. 4*a-c* on for example floor boards where the core material is made of a wood based material like fibre board, particle board, chip board, oriented strand board or massive wood. It is common knowledge among artisans that wood based materials will expand and contract depending on moisture content. This implies that a floor will be smaller in winter time when the moisture content in air at room temperature is lower than in late summer when the moisture content is high. This is observed by most people during the winter time when gaps often occur in wood flooring. The invention as described in connection to FIG. 4*a-c* will absorb this moisture propelled expansion and contraction. Typically around 1 mm per meter of floor will be more than enough to absorb. As one typical width of floor panels is 200 mm a sufficient movement allowed in a long side edge joint would be around ±0.1 mm. It is possible to use the joint described in FIG. 4*a-c* only on the long sides, the short sides or on all sides. It is also possible to use the herein described device on special places like doorways and the like or on every other or every third row of panels.

Referring now to FIG. 4*b* showing the assembled panels 1 from FIG. 4*a*. The joint is in a stretched state in FIG. 4*b*. This is the typical state the joint will be in during longer periods of very dry conditions. The flexible insert $\mathbf{27}^{I}$ is compressed while the polymer sealer 31 is slightly stretched.

Referring now to FIG. 4*c* showing the assembled panels 1 from FIG. 4*a*. The joint is in a compressed state in FIG. 4*c*. This is the typical state the joint will be in during longer periods of very humid conditions. The flexible insert $\mathbf{27}^{I}$ is unloaded while the polymer sealer 31 is compressed.

The joint shown in FIG. 4*a-c* will make normal dilation devices abundant and will make it possible to achieve door passages and very large surfaces without having to use any dilation devices.

The visible part of the polymer sealer can be dyed or lacquered to match the floor surface or to create any desired accent. It is also possible to provide it with a thin flexible foil or laminate provided with a printed decor. It is furthermore possible to provide the visible part of the polymer sealer with a printed decor directly on top of the visible surface. One known method for achieving this is the method of transfer printing. It is furthermore advantageous to at least blunt the edges of the upper surface closest to the polymer sealer.

It is also possible to provide the joint as shown in FIG. 3 with a flexible insert $\mathbf{27}^{I}$ to achieve flexibility in this joint as well. This flexible insert $\mathbf{31}^{I}$ is then suitably arranged on the mainly vertical upper cheek surfaces 22.

The invention is not limited by the embodiments shown since these can be varied in different ways within the scope of the invention.

We claim:

1. A panel comprising:

a core having an upper surface;

a decorative surface layer atop said upper surface of said core, wherein said decorative surface layer covers all of said upper surface;

edges, said edges comprising at least one joining element, said joining element being selected from the group consisting of a tongue and a groove; at least one of said edges comprising a mating surface below the decorative surface layer, and a recess extending from said upper surface towards said joining element, and a non-curing elastomeric polymer sealant positioned in said recess, wherein said sealant extends beyond the at least one of said edges of said panel to form said mating surface and the sealant being dyed or lacquered such that said sealant is visible when the panel is joined with an adjacent panel.

2. The panel of claim 1, wherein said sealant is a thermoplastic polymer.

3. The panel of claim 2, wherein said sealant comprises at least one component selected from the group consisting of nitrile butyl rubber, butyl rubber, ethyl-vinyl-acetate, and natural bitumen.

4. The panel of claim 3, wherein the sealant comprises butyl rubber.

5. The panel of claim 2, wherein said sealant comprises an expansion agent.

6. A system comprising:

the panel of claim 1, and a second panel, said second panel comprising:

a core having an upper surface, a decorative surface layer atop said upper surface of said core; and edges, said edges comprising at least one joining element, said joining element being selected from the group consisting of a tongue and a. groove;

wherein said panel and said second panel are joined at said respective joining elements, such that said sealant is visible in the joint between the panels and forms a seal therebetween.

7. The system of claim 6, wherein at least one of said edges of said second panel further comprises:

a recess in the core below said decorative surface, and a sealing component positioned in said recess.

8. The system of claim 7, wherein said sealing component is a second sealant.

9. The system of claim 8, wherein said sealing component in said recess comprises a component to activate said sealant on said panel.

10. The system of claim 9, wherein said first sealant lacks a plasticizer and said second component contains a plasticizer which migrates info said first sealant.

11. A method of forming a joint between adjacent panels comprising:

providing a first panel, said first panel comprising:

a core having an upper surface;

a decorative surface layer atop said upper surface of said core, wherein said decorative surface layer covers all of said upper surface;

edges, said edges comprising at least one joining element, said joining element being selected from the group consisting of a tongue and a groove; at least one of said edges comprising a mating surface below the decorative surface layer, and a recess extending from said upper surface towards said joining element, and a sealant positioned in said recess; wherein said sealant extends beyond an edge of said panel to form said mating surface and said sealant being dyed or lacquered, and, joining a second panel to said first panel by connecting a joining element on said second panel to said first panel, whereby said sealant is visible and seals the joint formed between the first and second panels.

12. The method of claim 11, whereby said second panel further comprises a sealant component on an edge thereof, said joining step comprising bringing together said first sealant and said sealant component.

13. The method of claim 12, wherein said bringing together step comprises activating said first sealant.

14. The method of claim 12, further comprising allowing said first sealant and said second sealant to form an elastic seal.

* * * * *